US005765734A

United States Patent [19]

Silverberg

[11] Patent Number: 5,765,734

[45] Date of Patent: Jun. 16, 1998

[54] APPARATUS FOR AND METHOD OF SECURELY HOLDING OBJECTS

[76] Inventor: Ian Silverberg, 170 Los Carneros Way, Goleta, Calif. 93117

[21] Appl. No.: 724,017

[22] Filed: Sep. 27, 1996

[51] Int. Cl.[6] ..... A63B 57/00

[52] U.S. Cl. ..... 224/250; 224/274; 224/901.2; 224/918

[58] Field of Search ..... 224/918, 901.4, 224/901.2, 250, 274

[56] References Cited

U.S. PATENT DOCUMENTS

| | | | |
|---|---|---|---|
| 4,498,615 | 2/1985 | Johnson | 224/274 |
| 5,050,830 | 9/1991 | Hall | 224/918 |
| 5,158,179 | 10/1992 | Gosselin | 224/918 |
| 5,269,410 | 12/1993 | Abregano | 224/274 X |
| 5,464,136 | 11/1995 | Eddy | 224/901.4 |
| 5,476,289 | 12/1995 | Hoyt et al. | 224/918 |

*Primary Examiner*—Renee S. Luebke
*Attorney, Agent, or Firm*—Haverstock & Owens LLP

[57] ABSTRACT

An object holder includes a first panel having loop fasteners on an interior side and a second panel having hook fasteners on an interior side. The first panel and the second panel are sealed together at one end around a clip holder. The clip holder holds a clip which is used to attach the object holder to another article, preferably a golf bag. The first and second panels are secured together by pressing the hook and loop fasteners together. Golf tees or other objects are held between the first and second panels either by inserting them between the first and second panels after the first and second panels are secured together or by positioning them between the first and second panels as the panels are being secured together. The golf tees or other objects are removed from the object holder by pulling them out from between the first and second panels. The first and second panels are separated by pulling apart the hook and loop fasteners.

16 Claims, 1 Drawing Sheet

APPARATUS FOR AND METHOD OF SECURELY HOLDING OBJECTS

FIELD OF THE INVENTION

The present invention relates to the field of holders and carriers. More particularly, the present invention relates to the field of holders and carriers for securely holding one or more objects.

BACKGROUND OF THE INVENTION

Golf tees are typically carried loose in a pocket on a golf bag with other equipment or in a golfer's pants pockets. When a golfer requires a golf tee, the golfer must usually search through other equipment in their pants pockets or in the golf bag to find a golf tee. Because the golf tee is a small object, sometimes this search can be difficult and frustrating if the pocket is full of other equipment. Similarly, pencils, pens or the like are sometimes carried in a box with other pencils, pens and equipment, making it sometimes difficult to find a particular pencil or pen among the other pencils and pens.

What is needed is a holder which will securely hold one or more objects. What is further needed is a holder which will securely hold one or more objects, from which the objects can be easily viewed and readily removed.

SUMMARY OF THE INVENTION

An object holder includes a first panel having loop fasteners on an interior side and a second panel having hook fasteners on an interior side. The first panel and the second panel are sealed together at one end around a clip holder. The clip holder holds a clip which is used to attach the object holder to another article, preferably a golf bag. The first and second panels are secured together by pressing the hook and loop fasteners together. Golf tees or other objects are held between the first and second panels either by inserting them between the first and second panels after the first and second panels are secured together or by positioning them between the first and second panels as the panels are being secured together. The golf tees or other objects are removed from the object holder by pulling them out from between the first and second panels. The first and second panels are separated by pulling apart the hook and loop fasteners.

DETAILED DESCRIPTION OF THE PREFERRED EMBODIMENT

An object holder includes a first panel having loop fasteners on one side and a second panel having hook fasteners on one side. One end of each of the first and second panels are sealed together around a clip holder. The opposite end of each of the first and second panels is loose. The first and second panels are attached together by applying pressure to the first and second panels so that the hook fasteners and the loop fasteners are pressed together. Preferably, golf tees are held between the first and second panels either by positioning them between the first and second panels as the panels are being attached together or by inserting the golf tees in between the first and second panels after the first and second panels are attached together. Alternatively, the object holder will hold other objects including but not limited to pencils, pens, nails and screws. The golf tees or other objects are removed from the object holder by pulling them from between the first and second panels. The first and second panels are separated by pulling the opposite ends of the panels apart. The clip holder holds a clip which is used to attach the object holder to another article, such as a golf bag.

Figure 1:
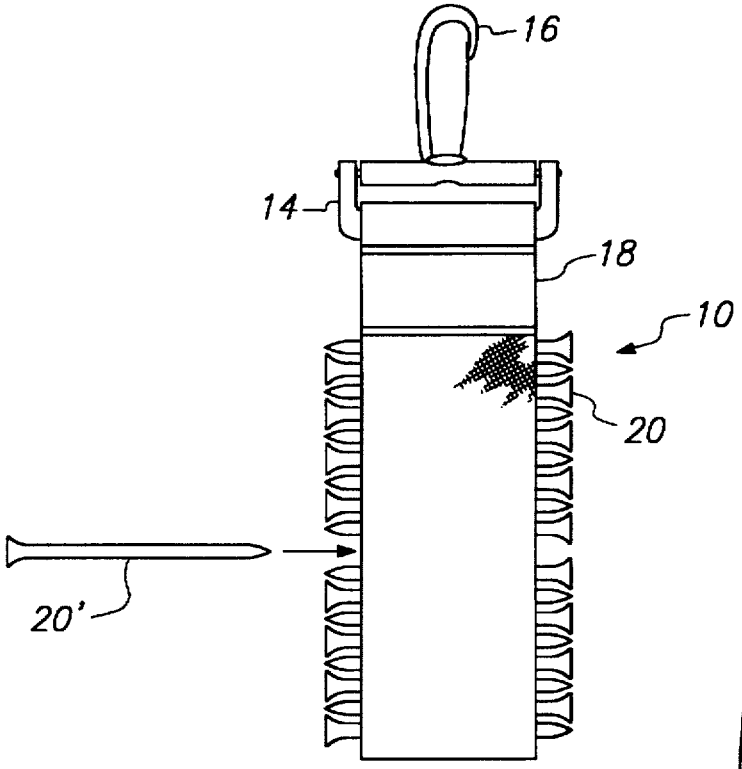
FIG. 1 illustrates a front view of an object holder of the present invention including a clip and clip holder.
Figure 2:
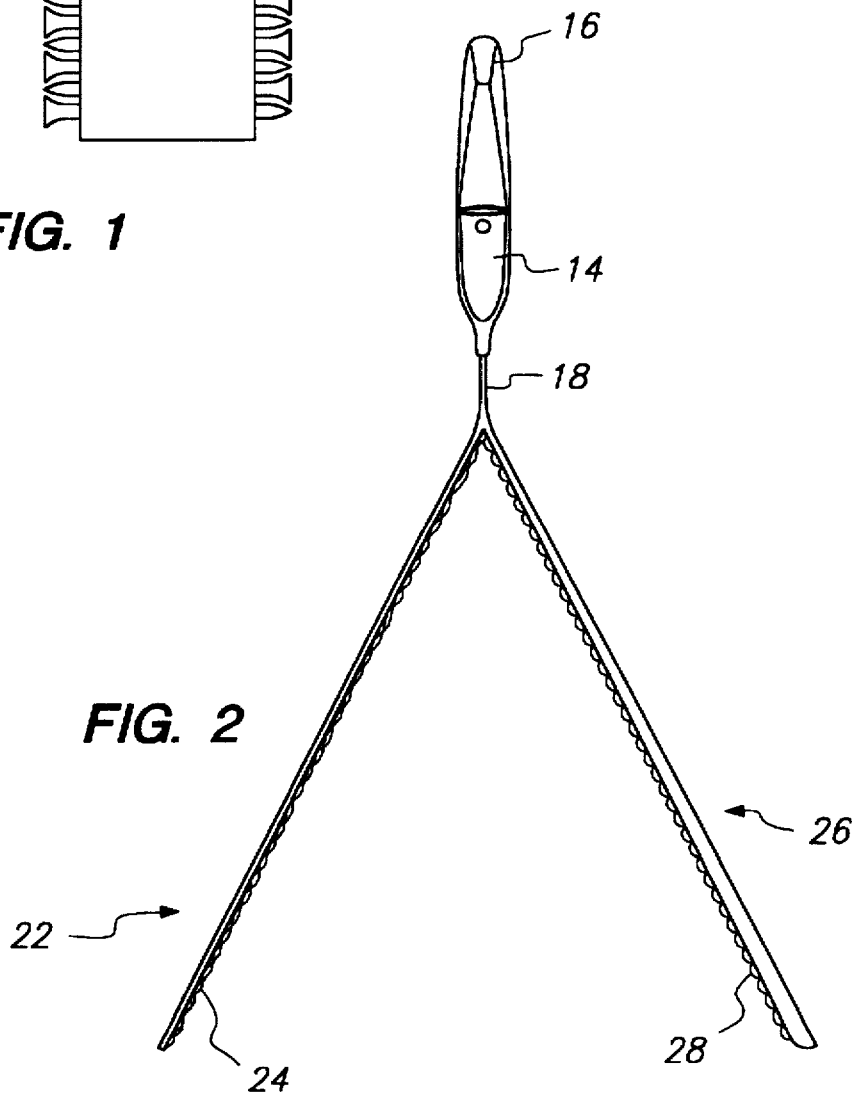
FIG. 2 illustrates a side view of the object holder of the present invention with first and second panels separated.

A front view of the object holder 10 is illustrated in FIG. 1. As illustrated in FIG. 1, the object holder 10 is holding a plurality of golf tees 20. The object holder 10 includes a first panel 22 and a second panel 26, as illustrated in the side view of FIG. 2. The first panel 22 includes an interior side having loop fasteners 24. The second panel 26 includes an interior side having hook fasteners 28. In the preferred embodiment, the panels are sealed together around a clip holder 14. The clip holder 14 is coupled to a clip 16 for attaching the object holder 10 to other objects or articles, such as a golf bag. When the interior side 24 of the first panel 22 and the interior side 28 of the second panel 26 are pressed together, the hook and loop fasteners are joined and securely hold the unsealed ends of the first panel 22 and the second panel 26 together. The unsealed ends of the first panel 22 and the second panel 26 are separated by pulling the hook and loop fasteners apart.

To construct the object holder 10 of the present invention, an end of the first panel 22 is permanently sealed to an end of the second panel 26 such that the interior side 24 and the interior side 28 are adjacent. The panels 22 and 26 are then positioned around the clip holder 14 such that their length extending from the clip holder 14 is substantially equal. The panels 22 and 26 are then permanently sealed together below the clip holder 14 at the area 18. The panels 22 and 26 are permanently sealed together and around the clip holder 14 at the area 18. Preferably, the panels 22 and 26 are sealed together at their ends and at the area 18 using a heat sealing method. Alternatively, the panels 22 and 26 are sealed together and around the clip holder 14 by using any other sealing method, such as ultrasonic sealing.

After being sealed around the clip holder 14, the unsealed ends of the panels 22 and 26 are secured together by pressing the panels 22 and 26 together, thereby causing the loop fasteners 24 to fasten to the hook fasteners 28. After being secured, the unsealed ends of the panels 22 and 26 are separated from each other by pulling the loop fasteners 24 away from the hook fasteners 28.

The golf tees 20 are secured between the first panel 22 and the second panel 26 by pushing a golf tee between the panels 22 and 26 and through the hook and loop fasteners, after the panels 22 and 26 are secured together. This is illustrated in FIG. 1 by the golf tee 20'. When fastened together and a golf tee is pushed through, the loop fasteners 24 and the hook fasteners 28 provide a tight fit to securely hold the golf tees 20 in place between the panels 22 and 26. Alternatively, the golf tees are secured between the first panel 22 and the second panel 26 by positioning the golf tees 20 between the panels 22 and 26 and then pressing the panels 22 and 26 together. In this manner, the loop fasteners 24 and the hook fasteners 28 are fastened together around the golf tees 20. This securing method is not preferred, because the golf tees 20 are not held as securely as if they are inserted through the hook and loop fasteners, after the panels 22 and 26 are secured together. The golf tees 20 are removed from the object holder 10 by pulling them out from between the first and second panels 22 and 26. After being removed, a golf tee can then be reinserted into the object holder 10 by pushing the golf tee between the panels 22 and 26 and through the hook and loop fasteners.

The object holder 10 of the preferred embodiment is intended to hold golf tees 20. As illustrated in FIG. 1, a larger quantity of golf tees 20 can be held by the object holder 10 if the orientation of the golf tees is alternated when inserted between the panels 22 and 26. Using the object holder 10 of the present invention, a golfer can secure the golf tees 20 between the panels 22 and 26 and attach the object holder 10 to their golf bag, so that their golf tees are readily available in an organized and efficient manner, eliminating the last minute scrambling and searching to find a golf tee within a pants pocket or a pocket on a golf bag. Similarly, as should be apparent to those skilled in the art, the object holder 10 can be used to hold other objects between the panels 22 and 26 in a similar manner, including but not limited to pencils, pens, nails and screws, in the same manner as described above for golf tees. For larger objects, the width of the panels 22 and 26 can be increased to provide the necessary support for securely holding the objects between the panels.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

I claim:

1. A method of securely holding one or more objects between a first panel and second panel sealed together around a securing means, the method comprising the steps of:

a. removably joining a first interior side of the first panel to a second interior side of the second panel, wherein the first interior side includes hook fasteners and the second interior side includes loop fasteners and the first and second interior sides are joined together by applying pressure to push the hook fasteners and the loop fasteners together and further wherein the first and second interior sides are separated by pulling the hook fasteners and the loop fasteners apart;

b. positioning the one or more objects between the first and second panels for being securely held between the first and second panels when the first and second panels are joined together.

2. The method as claimed in claim 1 wherein the step of positioning is completed after the step of removably joining and the one or more objects are inserted between the first and second panels and through the hook and loop fasteners.

3. The method as claimed in claim 1 wherein the step of positioning is completed before the step of removably joining such that the objects are securely held between the first and second panels when the first and second panels are joined together.

4. The method as claimed in claim 1 wherein the one or more objects are golf tees.

5. An apparatus for securely holding one or more objects comprising:

a. a first panel including a first interior side and a first exterior side, the first interior side including loop fasteners;

b. a second panel including a second interior side and a second exterior side, the second interior side including hook fasteners, wherein the first and second panels are joined together by pressing the first and second interior sides together and further wherein the one or more objects are securely held between the first and second panels when the first and second panels are joined together; and c. a securing means retained between a first end of both the first and second panels for securing the apparatus to an article.

6. The apparatus as claimed in claim 5 wherein the objects are securely held between the first and second panels after being inserted between the first and second panels and through the hook and loop fasteners when the first and second panels are joined together.

7. The apparatus as claimed in claim 5 wherein the objects are securely held between the first and second panels by positioning the objects between the first and second panels when the first and second panels are joined together.

8. The apparatus as claimed in claim 5 wherein the securing means is a clip.

9. The apparatus as claimed in claim 5 wherein the article is a golf bag.

10. The apparatus as claimed in claim 5 wherein the objects are golf tees which are securely held between the first and second panels when the first and second panels are joined together.

11. The apparatus as claimed in claim 10 wherein a pencil is also securely held between the first and second panels when the first and second panels are joined together.

12. An apparatus for securely holding one or more objects comprising:

a. a first panel including a first interior side and a first exterior side, the first interior side including loop fasteners;

b. a second panel including a second interior side and a second exterior side, the second interior side including hook fasteners, wherein the first and second panels are joined together by pressing the first and second interior sides together and the first and second panels are separated by pulling the first and second interior sides apart and further wherein the one or more objects are securely held between the first and second panels when the first and second panels are joined together; and c. a clip coupled to both the first and second panels for securing the apparatus to an article, wherein the first and second panels are sealed together around the clip.

13. The apparatus as claimed in claim 12 wherein the objects are golf tees.

14. An apparatus for carrying objects, wherein the apparatus is removably attachable to an article, the apparatus comprising:

a. a first panel including a first interior surface and a first exterior surface, the first interior surface including loop fasteners;

b. a second panel including a second interior surface and a second exterior surface, the second interior side including hook fasteners, wherein the objects are securely held between the first and the second panels when the first and second interior surfaces are removably joined together; and c. a securing means retained between both the first and second panels for removably attaching the apparatus to the article.

15. The apparatus according to claim 14 wherein the first and second panels are sealed together around the securing means.

16. The apparatus according to claim 14 herein the securing means is a clip.

* * * * *

UNITED STATES PATENT AND TRADEMARK OFFICE

CERTIFICATE OF CORRECTION

PATENT NO. : 5,765,734
DATED : June 16, 1998
INVENTOR(S) : Ian Silverberg

It is certified that error appears in the above-identified patent and that said Letters Patent is hereby corrected as shown below:

In column 4, line 64, delete "herein" and insert --wherein--.

Signed and Sealed this

First Day of September, 1998

Bruce Lehman

*Attest:*

BRUCE LEHMAN

*Attesting Officer*

*Commissioner of Patents and Trademarks*